US007815481B2

(12) United States Patent
Choi et al.

(10) Patent No.: US 7,815,481 B2
(45) Date of Patent: Oct. 19, 2010

(54) PLASMA DISPLAY PANEL, METHOD OF MANUFACTURING ELECTRODE BURYING DIELECTRIC WALL OF DISPLAY PANEL AND METHOD OF MANUFACTURING ELECTRODE BURYING DIELECTRIC WALL OF THE PLASMA DISPLAY PANEL

(75) Inventors: Woo-suk Choi, Yongin-si (KR); Eun-hee Kim, Yongin-si (KR)

(73) Assignee: Samsung Techwin Co., Ltd., Changwon (KR)

( * ) Notice: Subject to any disclaimer, the term of this patent is extended or adjusted under 35 U.S.C. 154(b) by 359 days.

(21) Appl. No.: 11/706,706

(22) Filed: Feb. 13, 2007

(65) Prior Publication Data

US 2007/0200500 A1 Aug. 30, 2007

(30) Foreign Application Priority Data

Feb. 27, 2006 (KR) ..... 10-2006-0018869

(51) Int. Cl.
*H01J 9/02* (2006.01)
*H01J 9/00* (2006.01)
*H01J 17/49* (2006.01)

(52) U.S. Cl. ..... 445/35; 445/46; 313/584

(58) Field of Classification Search ..... 313/582, 313/583, 584, 585, 586, 587; 445/35, 46
See application file for complete search history.

(56) References Cited

U.S. PATENT DOCUMENTS 3,866,084 A * 2/1975 Kurahashi et al. ..... 313/510
4,293,376 A * 10/1981 Weingand ..... 216/56
4,340,838 A * 7/1982 Kobale et al. ..... 313/348
5,336,121 A * 8/1994 Baret ..... 445/25
5,982,095 A * 11/1999 Jin et al. ..... 313/582
6,191,530 B1 * 2/2001 Fukuta et al. ..... 313/586
2004/0245929 A1 * 12/2004 Sakamoto ..... 313/584
2005/0148270 A1 * 7/2005 Eden et al. ..... 445/24
2005/0151476 A1 * 7/2005 Tachibana et al. ..... 313/585
2005/0212424 A1 * 9/2005 Kwon et al. ..... 313/582
2005/0231116 A1 * 10/2005 Yoo ..... 313/584
2005/0236990 A1 * 10/2005 Kim ..... 313/582

FOREIGN PATENT DOCUMENTS

KR 1020010068831 A 7/2001
KR 1020040050435 A 6/2004
KR 1020050040635 A 5/2005
KR 1020050113533 A 12/2005

OTHER PUBLICATIONS

U.S. Appl. No. 11/713,047.*
Office Action established for CN200710084231.5.

* cited by examiner

*Primary Examiner*—Nimeshkumar D Patel
*Assistant Examiner*—Steven Horikoshi
(74) *Attorney, Agent, or Firm*—Drinker Biddle & Reath LLP

(57) ABSTRACT

A plasma display panel, a method of manufacturing an electrode burying dielectric wall of a plasma display panel, and a method of manufacturing an electrode burying dielectric wall of the plasma display panel. The plasma display panel comprises a front substrate, a rear substrate separated from the front substrate in a vertical direction, front discharge electrodes and rear discharge electrodes disposed between the front substrate separated from one another by an insulating layer, a high dielectric layer surrounding the front discharge electrodes and the rear discharge electrodes, discharge cells, at least a portion of each discharge cell being surrounded by the high dielectric layer, a phosphor layer disposed in each of the discharge cells, and a discharge gas filled in the discharge cells.

13 Claims, 12 Drawing Sheets

PLASMA DISPLAY PANEL, METHOD OF MANUFACTURING ELECTRODE BURYING DIELECTRIC WALL OF DISPLAY PANEL AND METHOD OF MANUFACTURING ELECTRODE BURYING DIELECTRIC WALL OF THE PLASMA DISPLAY PANEL

BACKGROUND OF THE INVENTION

This application claims the priority of Korean Patent Application No. 10-2006-0018869, filed on Feb. 27, 2006, in the Korean Intellectual Property Office, the disclosure of which is incorporated herein in its entirety by reference.

1. Field of the Invention

The present invention relates to a method of manufacturing an electrode burying dielectric wall for a display, and more particularly, to a plasma display panel having excellent brightness and discharge efficiency and an improved structure of a dielectric wall for burying electrodes disposed in a region other than discharge cells, a method of manufacturing an electrode burying dielectric wall of a display panel and a method of manufacturing an electrode burying dielectric wall of the plasma display panel.

2. Description of the Related Art

Plasma display panels (PDP) have recently replaced conventional cathode ray tube (CRT) display devices. In a PDP, a discharge gas is sealed between two substrates on which a plurality of discharge electrodes are formed, a discharge voltage is applied, phosphor formed in a predetermined pattern by ultraviolet rays generated by the discharge voltage is excited whereby a desired image is obtained.

A conventional AC surface discharge type PDP includes a front substrate, sustain electrodes disposed on the front substrate, a front dielectric layer covering the sustain electrodes, a protective layer covering the front dielectric layer, a rear substrate opposing the front substrate, address electrodes disposed on the rear substrate to be parallel to one another, a rear dielectric layer covering the address electrodes, barrier ribs formed on the rear dielectric layer, and phosphor layers formed on a top surface of the rear dielectric layer and on sides of the barrier ribs.

However, in the conventional PDP, the sustain electrodes, the front dielectric layer and the protective layer sequentially formed on the sustain electrodes exist on the front substrate through which visible rays emitted from the phosphor layers in a discharge space pass. Due to the factors, there is a problem that a transmission ratio of the visible rays is about 60%.

In addition, the sustain electrodes that cause a discharge are formed on a top surface of the discharge space, that is, on an inner side surface of the front substrate through which the visible rays pass, so that a discharge is diffused from the inner side surface of the front substrate. Thus, there is an inherent problem that a luminous efficiency is lowered.

To address the problem, as Illustrated in FIG. 1, a plasma display panel (PDP) 10 disclosed in Korean Patent Laid-open Publication No. 2005-0113533 includes upper barrier ribs 40 which are disposed between a front substrate 20 and a rear substrate 30 separated from each other in a vertical direction, define discharge cells 50 together with the front substrate 20 and the rear substrate 30 and are formed of dielectric, and upper and lower discharge electrodes 43 and 44 disposed in the upper barrier ribs 40 to be separated from each other and to surround the discharge cells 50. That is, the upper barrier ribs 40 are disposed between the neighboring discharge cells 50 (not in the discharge space) in a vertical direction, and the upper and lower discharge electrodes 43 and 44 are disposed in the upper barrier ribs 40 to be separated from each other.

As such, the electrodes, the front dielectric layer, and the protective layer need not exist on the front substrate 20 so that an aperture ratio of the panel is significantly improved. In addition, the upper and lower discharge electrodes 43 and 44 that cause a discharge are disposed on sides of the discharge space so that a discharge area is increased and a luminous efficiency is improved. A protective layer 49 may be applied to sides of the upper barrier ribs 40.

Address electrodes 33, a rear dielectric layer 35 covering the address electrodes 33, lower barrier ribs 37 formed on the rear dielectric layer 35, and phosphor layers 39 formed on a top surface of the rear dielectric layer 35 and on sides of the lower barrier ribs 37, are disposed on the rear substrate 30.

In this case, in the prior art, a plurality of barrier ribs formed of dielectric are stacked so that the upper barrier ribs 40 having the above structure are formed. That is, as illustrated in FIG. 2, one upper barrier rib 40 can be formed in such a manner that a first barrier wall portion 40*a*, a second barrier wall portion 40*b*, and a third barrier wall portion 40*c* are sequentially stacked on a bottom surface of the front substrate 20. In this case, the first, second, and third barrier wall portions 40*a*, 40*b*, and 40*c* are formed of dielectric.

A process of manufacturing the upper barrier ribs 40 will now be briefly described. The first barrier wall portion 40*a* is formed on the bottom surface of the front substrate 20. After that, the upper discharge electrodes 43 are formed on the first barrier wall portion. 40*a* in a printing manner and then, the second barrier wall portion 40*b* , is formed to bury the upper discharge electrodes 43. After that, the lower discharge electrodes 44 are formed on the second barrier wall portion 40*b* in a printing manner and then, the third barrier wall portion 40*c* is formed to bury the lower discharge electrodes 44, thereby manufacturing the upper barrier ribs 40 for burying the upper and lower discharge electrodes 43 and 44. In this case, in order to form the first barrier wall portion 40*a*, the second barrier wall portion 40*b*, and the third barrier wall portion 40*c* of the upper barrier ribs 40, respectively, an operation of patterning a dielectric paste in a predetermined shape should be performed and baking should be performed in the patterning operation so that resin components are necessarily removed from the dielectric paste.

However, temperature for baking is over 500° C. Thus, the types of materials that can be used to form the upper barrier ribs 40 are restricted so that the upper barrier ribs 40 can withstand the baking temperature. That is, a main component of the upper barrier ribs 40 should be PbO, $B_2O_3$, and $SiO_2$ etc., for example, which are materials for a conventional front dielectric layer. These materials have dielectric constants of 8-12. Thus, the upper barrier ribs 40 need to be formed at a predetermined thickness, for example, to a large thickness of 80-120 μm, so that electric conductivity of the upper barrier ribs 40 can be properly set. Accordingly, costs for the upper barrier ribs 40 increase and the discharge space is reduced.

In addition, since the upper and lower discharge electrodes 43 and 44 are manufactured in a printing manner, an electrode width is about over 60 μm, for example, and there are limitations in making the electrode width fine. In addition, the thickness of the electrode cannot be increased.

The upper barrier ribs 40 can be manufactured in a sheet shape. In this case, a portion of a raw material for the upper barrier ribs 40 corresponding to the discharge space is removed using mechanical drill, thereby manufacturing the upper barrier ribs 40. By using the mechanical drill, a manufacturing time is increased and productivity is lowered.

SUMMARY OF THE INVENTION

The present invention provides a plasma display panel (PDP) having a structure in which the height of an electrode buried in a dielectric wall of the PDP having an increased discharge space and a high light transmission ratio and a thickness of a dielectric layer burying the electrode can be adjusted, a method of manufacturing an electrode burying dielectric wall of the PDP and a method of manufacturing an electrode burying dielectric wall of a display panel.

The present invention also provides a method of manufacturing an electrode burying dielectric wall of a display panel in which a process of manufacturing electrodes and a dielectric layer burying the electrodes is simple, reliability is high and manufacturing costs are reduced, and a method of manufacturing an electrode burying dielectric wall of the plasma display panel.

According to an aspect of the present invention, there is provided a plasma display panel, the plasma display panel including: a front substrate; a rear substrate separated from the front substrate in a vertical direction; an electrode group including front discharge electrodes and rear discharge electrodes, the front discharge electrodes and the rear discharge electrodes being disposed between the front substrate and the rear substrate to be separated from one another to correspond to one another in a vertical direction; an insulating layer disposed between the front substrate and the rear substrate in a vertical direction, the insulating layer being disposed between the front discharge electrodes and the rear discharge electrodes; a high dielectric layer surrounding the front discharge electrodes and the rear discharge electrodes; discharge cells, at least a portion of each discharge cell being surrounded by the high dielectric layer; a phosphor layer disposed in each of the discharge cells; and a discharge gas filled in the discharge cells.

The insulating layer may include a material selected from the group consisting of polyimide, FR-6, and glass fiber reinforced epoxy.

The insulating layer may have a larger anti-compressive property than that of the high dielectric layer.

The high dielectric layer may be formed of a material having a dielectric constant of 2-4 and an insulating withstanding voltage of 30-400 V/μm and may have a thickness of 0.1-0.5 mm.

According to another aspect of the present invention, there is provided a method of manufacturing an electrode burying dielectric wall for a display panel for realizing an image through a discharge in a discharge space between substrates separated from each other in a vertical direction and in which at least two electrodes disposed between the substrates in a vertical direction are buried in the vertical direction at regular intervals, the method including: providing a base plate; forming electrode seed layers made of a conductive material on at least one side of the base plate; forming a resist layer for forming electrodes on the electrode seed layers; forming the electrodes in a region in which the resist layer is not formed, by electroplating the electrode seed layers; removing the resist layer on the base plate and a portion of the electrode seed layers which are disposed at the same position as that of the resist layer; removing a portion of the base plate corresponding to the discharge space; and surrounding the electrodes with dielectric.

The resist layer may be formed of a photosensitizer, and the removing of the resist layer corresponding to a position in which the electrodes of the electrode seed layers are formed may be performed by exposing and developing the resist layer.

The electrode seed layers may be formed on both sides of the base plate, and between the providing of the base plate and the forming of the resist layer, and the method may further include: forming at least one through hole in the base plate; and forming a hole correspondence seed layer connected to one of the electrode seed layers formed on top and bottom surfaces of the base plate, on an inner side surface of the through hole.

The electrode seed layers may include a material selected from the group consisting of Ni, Cu, Cr, and Pd.

According to another aspect of the present invention, there is provided a method of manufacturing a dielectric wall for a plasma display panel having the above structure and in which front and rear discharge electrodes are buried, the method including: providing an insulating layer; forming electrode seed layers made of a conductive material on both sides of the insulating layer; forming a resist layer in a portion of the electrode seed layers, the portion in which front and rear discharge electrodes are not formed; forming front and rear discharge electrodes in a region in which the resist layer is not formed, by an electroplating side of the electrode seed layers; removing the resist layer on both sides of the insulating layer and a portion of the electrode seed layers which are disposed at the same position as that of the resist layer; removing a portion of the insulating layer corresponding to a discharge space; and surrounding the insulating layer, the electrode seed layers, and the front and rear discharge electrodes by a high dielectric layer and burying them.

BRIEF DESCRIPTION OF THE DRAWINGS

The above and other aspects and advantages of the present invention will become more apparent by describing in detail exemplary embodiments thereof with reference to the attached drawings in which:

FIGS. 9 through 16 are cross-sectional views of each of operations of FIG. 8, that is, FIG. 9 is a cross-sectional view illustrating an operation of providing a base plate;

FIG. 10 is a cross-sectional view illustrating an operation of forming electrode seed layers made of a conductive material on at least one side of the base plate;

FIG. 12 is a cross-sectional view illustrating an operation of forming electrodes in a position in which the resist layer is not formed;

FIG. 13 is a cross-sectional view illustrating an operation of removing the resist layer that exists on the base plate and the electrode seed layers disposed in the same position as the resist layer;

FIG. 14 is a cross-sectional view illustrating an operation of removing a portion of the base plate corresponding to the discharge space;

FIG. 15 is a cross-sectional view illustrating an operation of burying the remaining base plate, the electrode seed layers and the electrodes with dielectric;

FIG. 16 is a cross-sectional view of a modified example of FIG. 15;

DETAILED DESCRIPTION OF THE INVENTION

Figure 1:
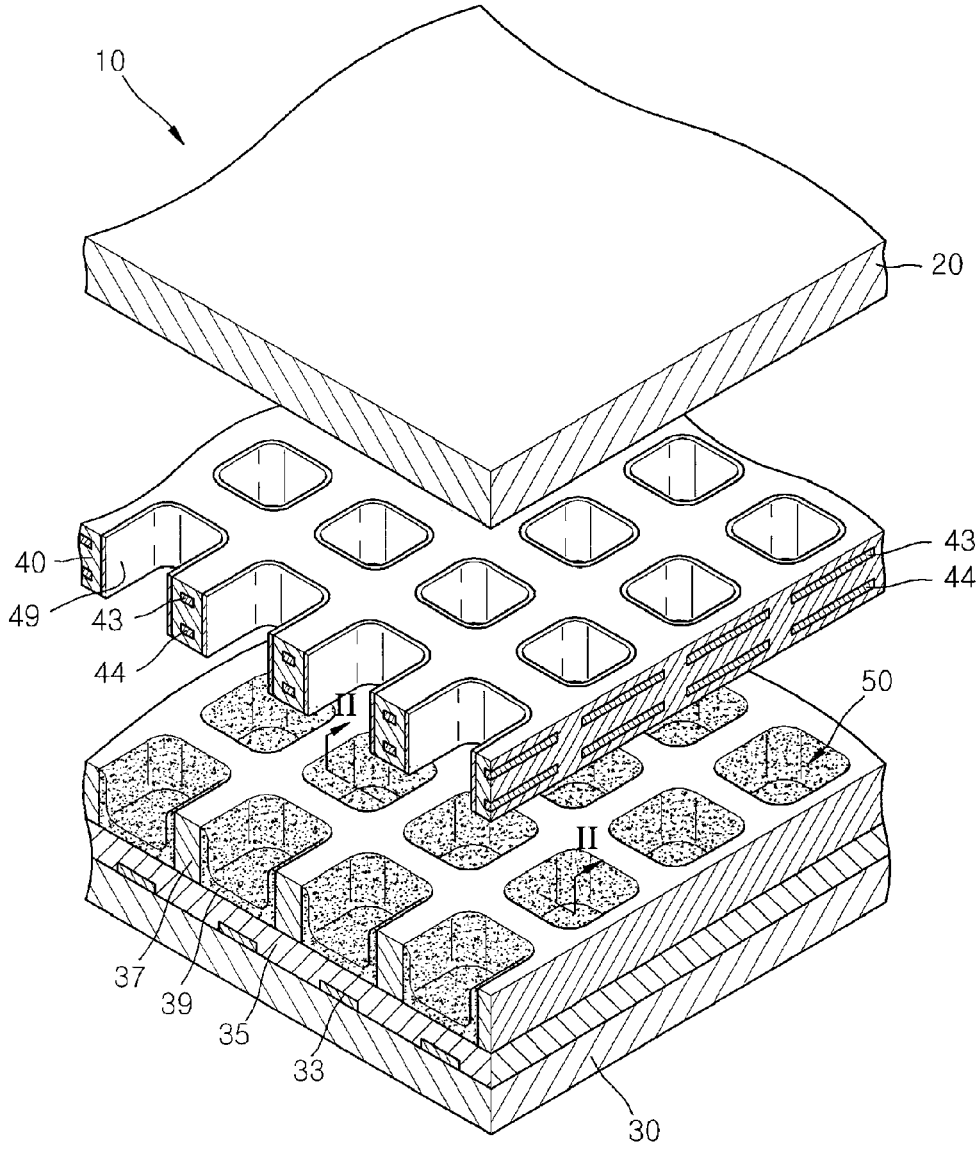
FIG. 1 (PRIOR ART)
FIG. 1 is an exploded perspective view of a conventional plasma display panel (PDP)
Figure 2:
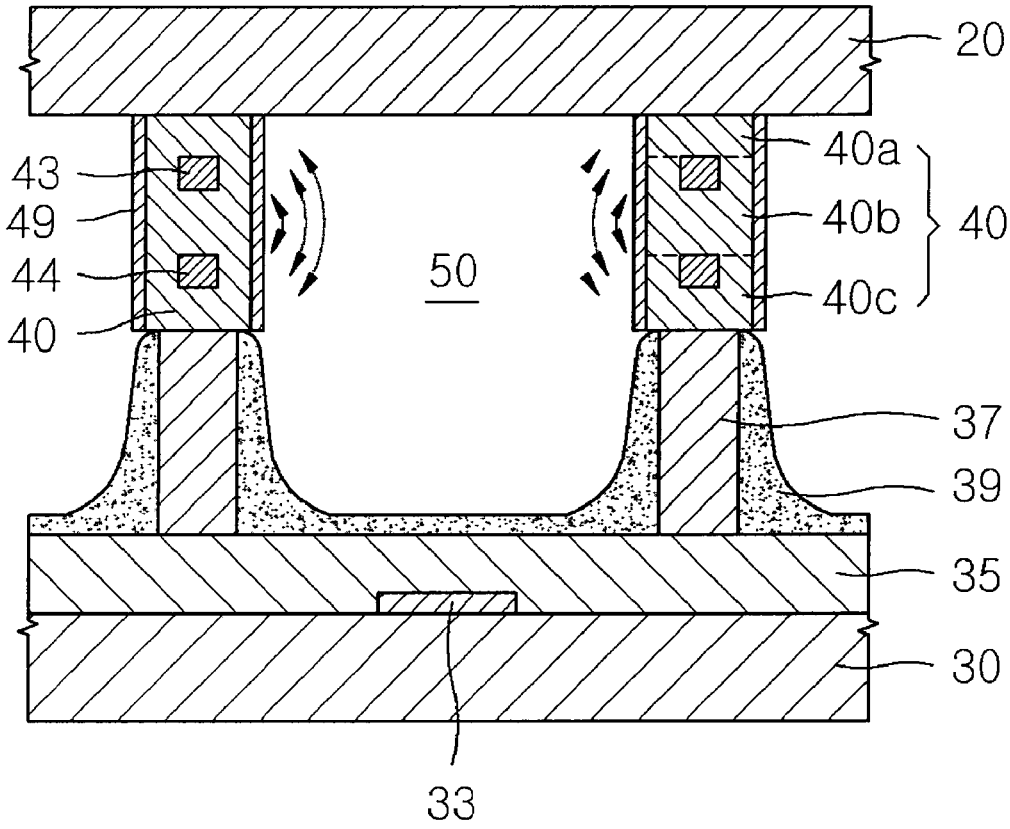
FIG. 2 (PRIOR ART)
FIG. 2 is a cross-sectional view of the PDP taken along line II-II of FIG. 1.

The present invention will now be described in greater detail by explaining exemplary embodiments of the invention with reference to the attached drawings.

As illustrated in FIGS. 3 through 6, a PDP 100 includes a front substrate 120, a rear substrate 130, electrode groups 150, at least one dielectric wall 140, phosphor layers 139, discharge cells 160, and a discharge gas (not shown).

Visible rays are emitted through the front substrate 120. Thus, the front substrate 120 is formed of a light-passing material. In this case, the front substrate 120 may be formed of a transparent material. The rear substrate 130 is separated from the front substrate 120 in a vertical direction. At least a portion of the rear substrate 130 can be disposed to overlap the front substrate 120.

Figure 3:
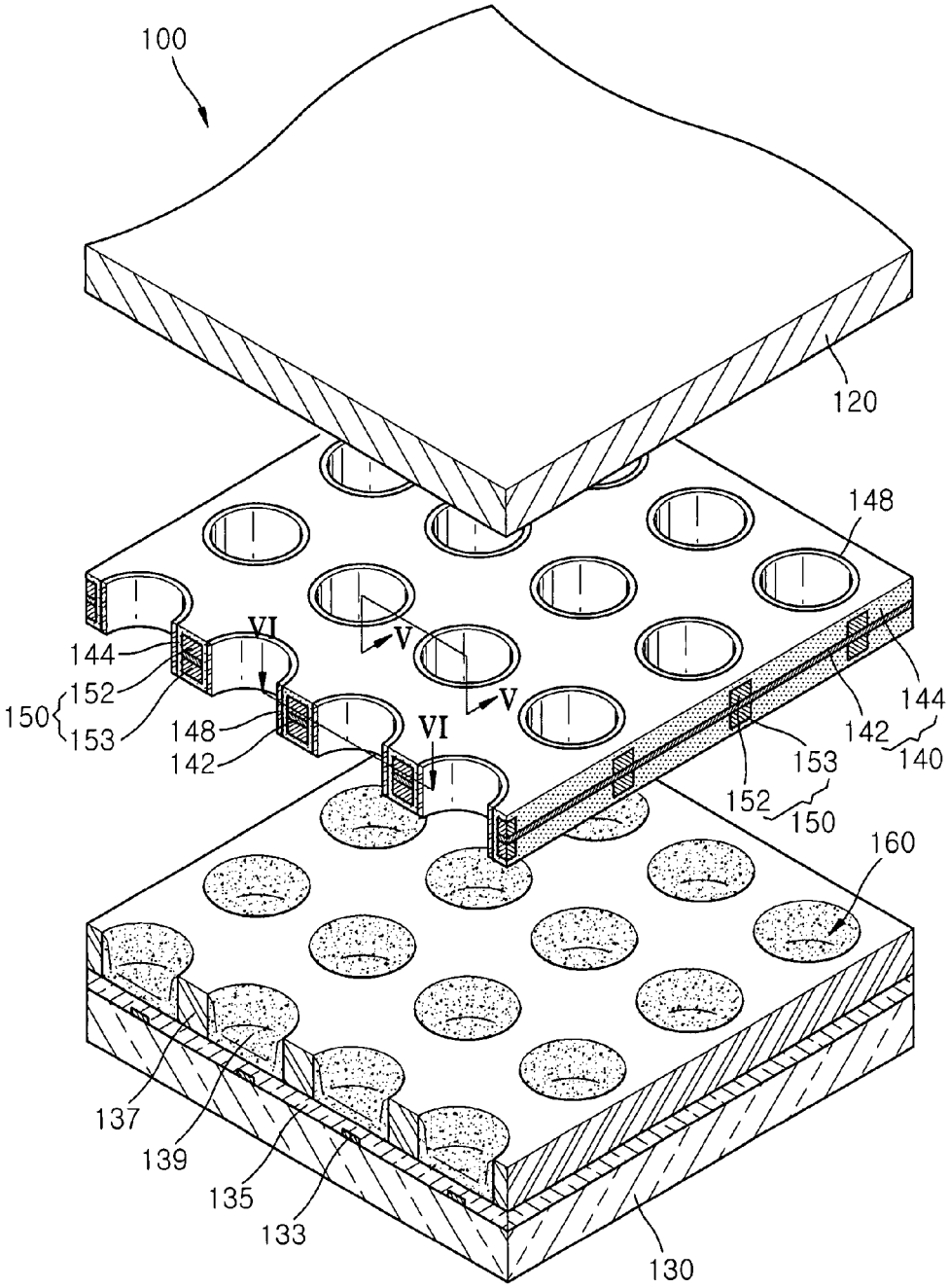
FIG. 3 is a partially-cut exploded perspective view of a PDP according to an embodiment of the present invention.

The dielectric wall 140 is disposed between the front substrate 120 and the rear substrate 130. In this case, the dielectric wall 140 can define the discharge cells 160 together with the front substrate 120, the rear substrate 130. The dielectric wall 140 is disposed in a circular shape and can define the circular discharge cells 160, as illustrated in FIG. 3. Alternatively, the dielectric wall 140 may be formed in a variety of other shapes such as a meander, a delta, a hexagon, a honeycomb or a grating shape. In addition, the discharge cells 160 defined by the dielectric wall 140 may be formed in a variety of shapes The dielectric wall 140 prevents a discharge between the discharge cells 160 from occurring and prevents the front and rear discharge electrodes from being damaged by positive ions or electrons during a discharge. The dielectric wall 140 includes an insulating layer 142 and a high dielectric layer 144. The insulating layer 142 is disposed between front discharge electrodes 152 and rear discharge electrodes 153, as will be described later, and the high dielectric layer 144 surrounds at least the front and rear discharge electrodes 152 and 153.

The electrode group 150 is buried in the high dielectric layer 144. The electrode group 150 includes the front discharge electrodes 152 and the rear discharge electrodes 153 separated from each other in a vertical direction.

In this case, the front discharge electrodes 152 and the rear discharge electrodes 153 may cross one another. That is, the front discharge electrodes 152 extend along the discharge cells 160 in one row and the rear discharge electrodes 153 may extend along the discharge cells 160 in another row that crosses rows of the discharge cells 160 in which the front discharge electrodes 152 follow. In this case, one of the front discharge electrodes 152 and the rear discharge electrodes 153 may serve as scanning electrodes and the other one thereof may serve as common electrodes. Simultaneously, one of the front discharge electrodes 152 and the rear discharge electrodes 153 may serve as address electrodes that cause an address discharge.

Figure 4:
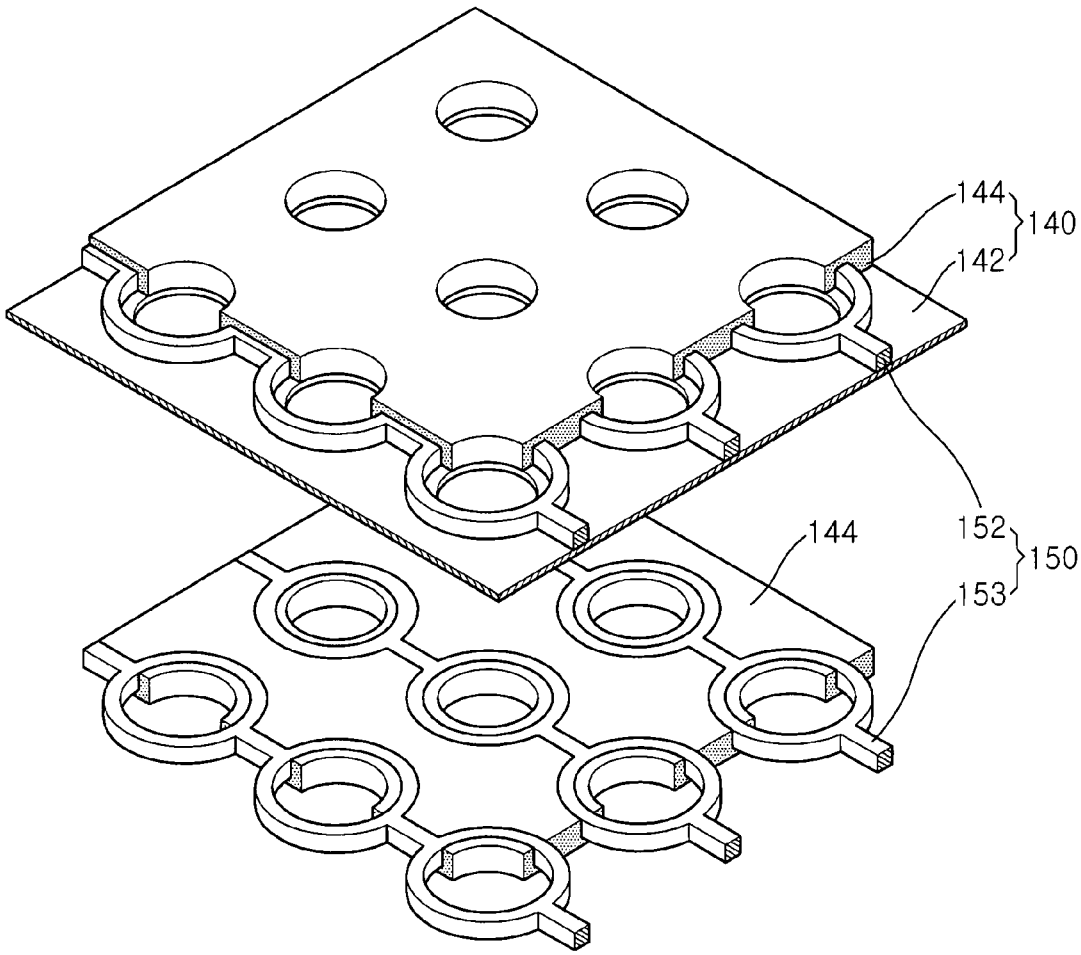
FIG. 4 is a perspective view of the arrangement of electrode groups and dielectric walls of the PDP illustrated in FIG. 3.
Figure 5:
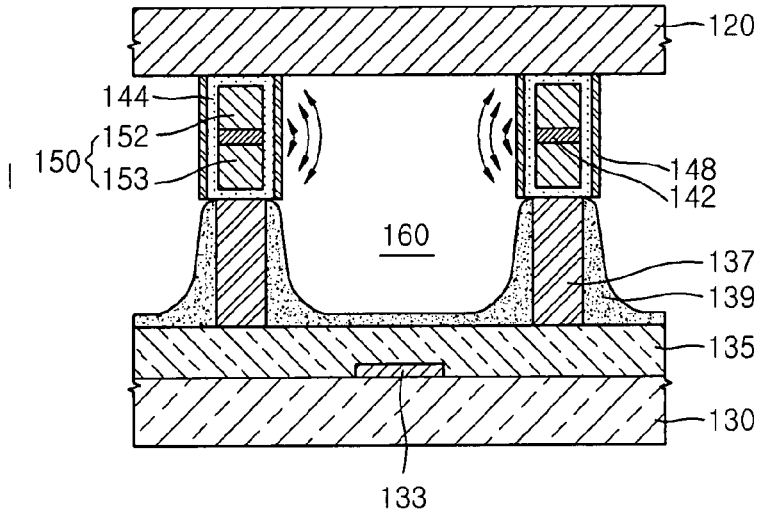
FIG. 5 is a cross-sectional view of the PDP taken along line V-V of FIG. 3.

Alternatively, as illustrated in FIG. 4, the front discharge electrodes 152 and the rear discharge electrodes 153 may extend in one direction to be parallel to one another. In this case, as illustrated in FIG. 3, the address electrodes 133 may extend so that the front discharge electrodes 152 and the rear discharge electrodes 153 cross one another. In this case, the address electrodes 133 cause an address discharge in which a sustain discharge between the front discharge electrodes 152 and the rear discharge electrodes 153 is more easily performed. More specifically, the address electrodes 133 reduce a voltage in which a sustain discharge is fired.

In this case, the address discharge is a discharge which occurs between scanning electrodes and address electrodes. If the address discharge is terminated, positive ions are accumulated on the scanning electrodes and electrons are accumulated on the common electrodes. As a result, a sustain discharge between the scanning electrodes and the common electrodes can be more easily performed.

The address electrodes 133 may be disposed on one side surface of the rear substrate 130 and may be buried by the rear dielectric layer 135.

As described above, since the electrode group 150 is disposed in the high dielectric layer 144, they are not located on a light path on which visible rays proceed. Accordingly, transmission of the visible rays need not to be considered. Thus, electrodes of the electrode group 150 need not to be formed of transparent indium tin oxide (ITO) electrodes. The electrodes of the electrode group 150 can be formed of Ag, Cu or Cr, which is a metal having good electric conductivity. Thus, screen nonuniformity caused by the ITO electrodes and an increase in manufacturing costs can be prevented.

In addition, unlike in a conventional AC type PDP, since the electrode group 150 is disposed in the dielectric wall 140, the electrode group 150 does not exist on the light path on which the visible rays proceed. Thus, the visible rays are not intercepted due to the existence of the electrodes and brightness is improved.

When a pulse voltage is applied to electrodes disposed inside the dielectric wall 140, the dielectric wall 140 induces wall charges which are conducive to a discharge, by inducing charged particles and enables driving using a memory effect. The dielectric wall 140 prevents the electrode group 150 from being damaged by collision of the charged particles accelerated during a discharge.

Barrier ribs 137 can be formed between the rear substrate 130 and the dielectric wall 140. In this case, the barrier ribs 137 can partition off the discharge cells 160 together with the dielectric wall 140. The barrier ribs 137 may be formed of a glass component including elements such as Pb, B, Si, Al, and O etc. If necessary, the glass component may include a filler such as $ZrO_2$, $TiO_2$, and $Al_2O_3$ and a pigment such as Cr, Cu, Co, Fe, and $TiO_2$.

The phosphor layers 139 may be disposed on sides of the barrier ribs 137 and upper side of the rear substrate 130. However, locations of the phosphor layers 139 are not limited to this and the phosphor layers 139 may also be disposed on a bottom surface of the front substrate 120 and on sides of the dielectric wall 140. In addition, the phosphor layers 139 may be disposed in a location in which UV rays generated by a discharge of ions in the discharge cells 160 and visible rays are emitted.

A protective layer 148 is formed on the surface of the dielectric wall 140 so that secondary electrons can be emitted by an interaction between ions generated inside the front substrate 120 along four sides of the discharge cells 160 with the surface of the dielectric wall 140. The protective layer 148 may be applied within each of the discharge cells 160. Although not shown, the protective layer 148 may also cover a rear side of the dielectric wall 140. The protective layer 148 may be disposed using deposition etc. using MgO etc. Since the protective layer 148 is not disposed on the light path on which the visible rays proceed, the protective layer 148 may also be formed of a material such as carbon nanotubes (CNTs) having excellent secondary electron emission characteristics and good durability.

A discharge gas such as Ne—Xe or He—Xe is filled in the discharge cells 160 defined by the front substrate 120 and the rear substrate 130 and-the dielectric wall 140.

Figure 6:
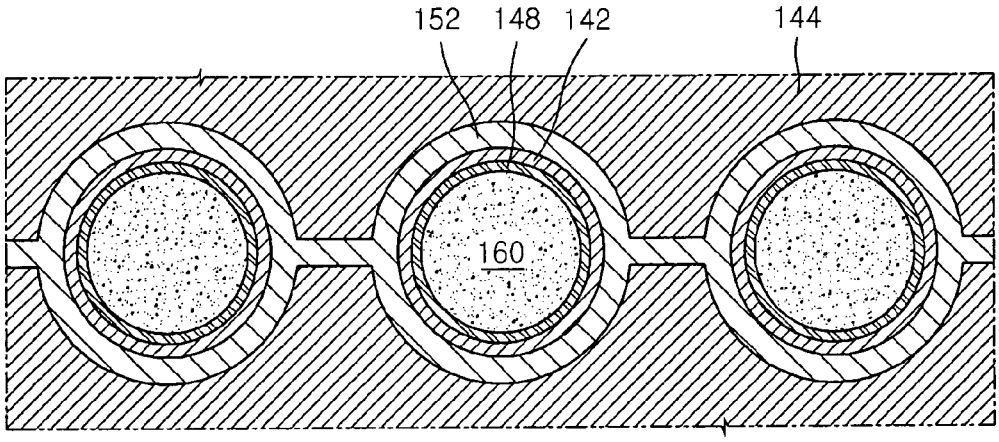
FIG. 6 is a cross-sectional view of the PDP taken along line VI-VI of FIG. 3.

In addition, the discharge cells 160 may not have a closed cross section but a cross-section of the discharge cells 160 may be defined in a stripe shape. However, as illustrated in FIG. 6, it is more preferable that the cross-section of the discharge cells 160 is formed in a closed shape, because electrodes are disposed in the dielectric rib 130 to surround the discharge cells 160 so that a three-dimensional discharge occurs and the amount of discharge can be increased.

The phosphor layers 139 can be classified into red, green, and blue light-emitting phosphor layers so that the PDP 100 can produce a color image. The red, green, and blue light-emitting phosphor layers are disposed inside the discharge cells 160 and are mixed with one another so that unit pixels for realizing color images can be formed.

The high dielectric layer 144 has a larger dielectric constant than that of the insulating layer 142. Thus, when ions move due to a difference between voltages applied to the front discharge electrodes 152 and the rear discharge electrodes 153, a large portion of ions moves to the high dielectric layer 144 disposed on sides of the front and rear discharge electrodes 152 and 153 and a ratio of ions that move to the insulating layer 142 is minimized. As such, the number of ions discharged in a discharge space increases so that the discharge efficiency is improved and the interval between the front discharge electrodes 152 and the rear discharge electrodes 153 can be adjusted so that discharge characteristics can be adjusted. The insulating layer 142 between the front and rear discharge electrodes 152 and 153 can be prevented from being damaged by ion sputtering.

The insulating layer 142 may be formed of an anti-compressive material. As such, when the PDP 100 is manufactured, one of the front and rear discharge electrodes 152 and 153 can be prevented from being close to neighboring discharge electrodes to a proper level due to gravity.

In this case, the insulating layer 142 may be formed of an organic material. The organic material may include polyimide, FR-6 or glass fiber reinforced epoxy. The material can be used to form a raw material of a lead frame in a semiconductor package. One of reasons that the insulating layer 142 is formed of an organic material is that the front and rear discharge electrodes 152 and 153 and the dielectric wall 140 for burying them can be manufactured without performing a backing process, which will be described later.

The insulating layer 142 is formed of an organic material so that manufacturing costs can be reduced. In addition, due to flexibility, the organic material withstands a stress such as an external shock. Furthermore, a hole can be formed in the organic material using a laser drill so that productivity can be improved.

The insulating layer 142 may be formed to a thickness of 0.01-1 mm.

The high dielectric layer 144 can be formed of a polymer material. Polymer has a high dielectric constant so that its thickness can be reduced and it has high flexibility. In this case, the high dielectric layer 144 may have a dielectric constant of 2-4 and a thickness of 0.1-0.5 mm. Furthermore, the high dielectric layer 144 has an insulating withstanding voltage of 30-400 V/μm so that insulation destruction of the small thickness can be prevented. One of reasons that the high dielectric layer 144 can be formed of a polymer material is that the high dielectric layer 144 can be manufactured without a backing process, which will be described later.

Figure 7:
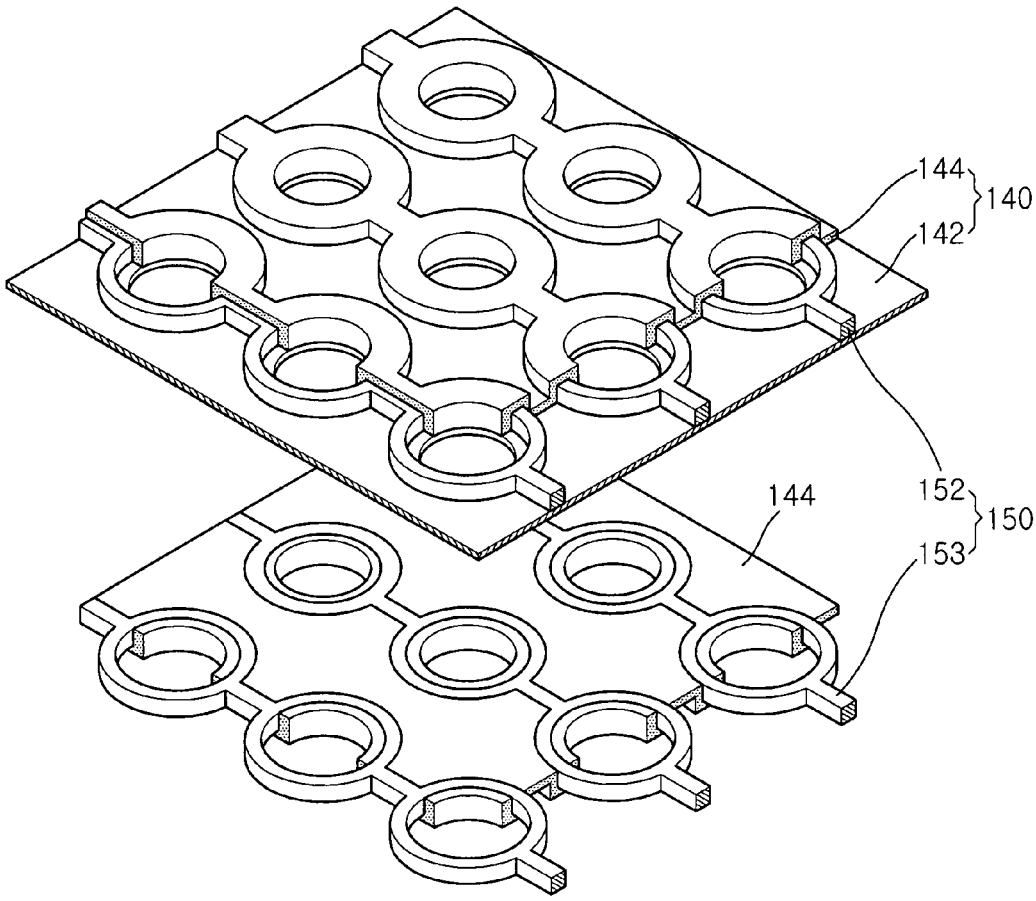
FIG. 7 is a perspective view of a modified example of FIG. 4.

As illustrated in FIG. 4, front and rear sides of the high dielectric layer 144 may be planar. Alternatively, as illustrated in FIG. 7, the high dielectric layer 144 are formed to the same thickness using processes such as coating so that the high dielectric layer 144 can be indented depending on whether or not the electrode groups 150 are formed.

A method of manufacturing the electrode groups 150 and the dielectric walls for burying the electrode groups 150 of the plasma display panel 100 will now be described. For ease of explanation, the dielectric walls of the PDP 100 will be described but the present invention is not limited to this. That is, as a display panel in which electrons move in discharge cells between substrates separated from each other in a vertical direction and images are realized, if the display panel includes an electrode burying dielectric wall 140 which is disposed between the substrates in a vertical direction and in which at least two electrodes for moving the electrons are buried in a vertical direction at regular intervals, the manufacturing method according to the present invention can be used.

Figure 8:
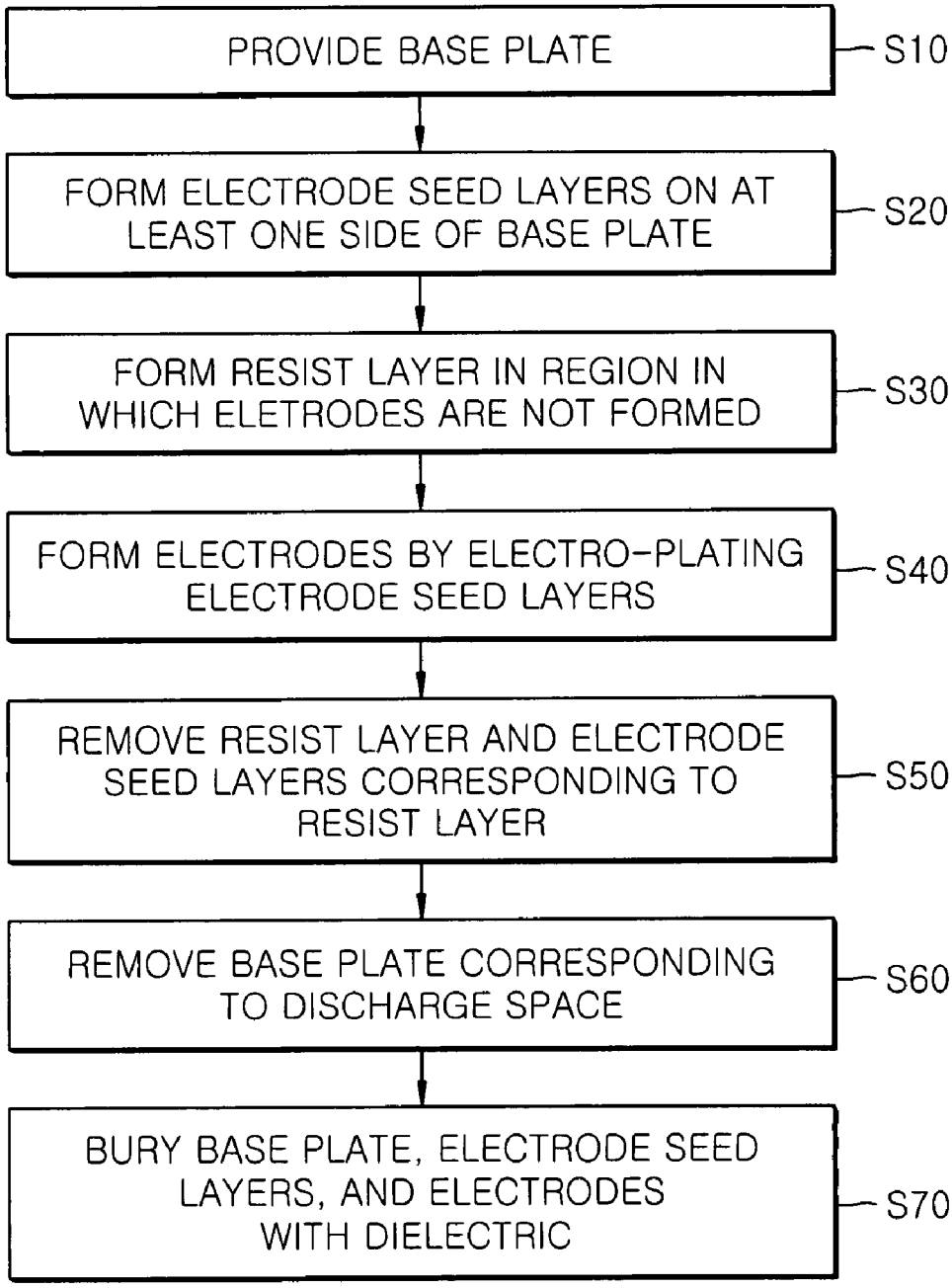
FIG. 8 is a flowchart illustrating a method of manufacturing an electrode burying dielectric wall of a display panel according to an embodiment of the present invention.

FIG. 8 is a flowchart illustrating a method of manufacturing an electrode burying dielectric wall of a display panel according to an embodiment of the present invention. As illustrated in FIG. 8, the method of manufacturing electrode burying dielectric ribs includes providing a base plate (S10), forming electrode seed layers made of metal on at least one side of the base plate (S20), forming a resist layer on which electrodes of the electrode seed layers are to be formed (S30), forming electrodes in a region in which the resist layer is not formed, by electro-plating the electrode seed layers (S40), removing the resist layer and the electrode seed layers disposed below the resist layer (S50), removing a portion of the base plate corresponding to a discharge space (S60), and burying the base plate, the electrode seed layers, and the electrodes with dielectric (S70).

Figure 9:
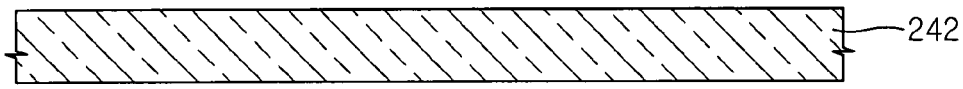

FIGS. 9 through 16 are cross-sectional views illustrating the method of manufacturing the electrode burying dielectric wall of the display panel. Each of operations will now be described in detail with reference to FIGS. 9 through 16. First, as illustrated in FIG. 9, a base plate 242 is provided. If an electrode burying dielectric wall 240 (see FIG. 15) manufactured according to the present invention is the electrode burying dielectric wall 140 of the PDP 100 illustrated in FIGS. 3 through 8, the base plate 242 is a raw material layer of the insulating layer 142 of the PDP 100.

The base plate 242 is a raw material layer of a printed circuit board (PCB) and may be formed of an organic material. The base plate 242 is formed of an organic material so that ductility of the dielectric walls becomes large and the base plate 242 is not sensitive to an external stress, material costs are reduced and manufacturing costs can be reduced. In this case, the base plate 242 may be formed of at least one material selected from the group consisting of polyimide, FR-6, and glass fiber reinforced epoxy. A material for the base plate 242 is not limited to the organic material and a material, such as ceramics, that can be used to form a row material layer of the printed circuit board (PCB) is included in the present invention.

The material of the base plate 242 can be selected in consideration of the dielectric constant and ductility, etc. In this case, the base plate 242 may have a lower dielectric constant than a dielectric which will be described later. This is because the amount of ions generated in electrodes that move to the discharge space can be maximized. In addition, the base plate 242 may be formed of a high anti-compressive material. This is because adjacent electrodes in a state where the base plate 242 is placed between the electrodes can be prevented from being close to one another at regular intervals due to a compressive force such as gravity, etc. The base plate 242 is formed of an organic material so that a thickness of the base plate 242 can be formed to a thickness of 0.01-1 mm.

Figure 10:
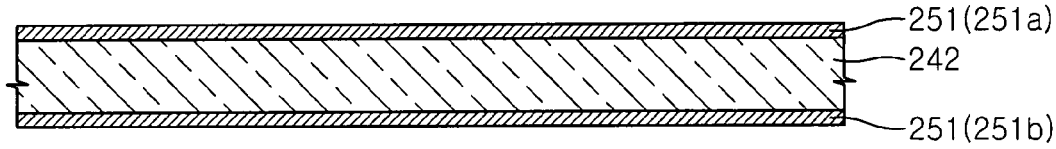

After that, as illustrated in FIG. 10, electrode seed layers 251 made of a conductive material are formed on at least one side of the base plate 242. The electrode seed layers 251 may be formed of metal. For example, the electrode seed layers 251 may be formed of one material selected from the group consisting of Ni, Cr, Cu or Pd.

If the electrode burying dielectric walls 240 have the same structure as that of the electrode burying dielectric walls 140 of the PDP 100 illustrated in FIGS. 3 through 8, the electrode seed layers 251 may be formed of a conductive material on both sides of the base plate 242. Accordingly, the electrodes 252 and 253 (see FIG. 12) may be disposed on top and bottom surfaces of the base plate 242, respectively. In this case, if the electrodes 252 and 253 to be manufactured according to the present invention are electrodes of the PDP 100, the top electrode seed layer 251*a* is a seed layer of the front discharge electrode 152 and the bottom electrode seed layer 251*b* may be a seed layer of the rear discharge electrode 153.

Figure 11A:
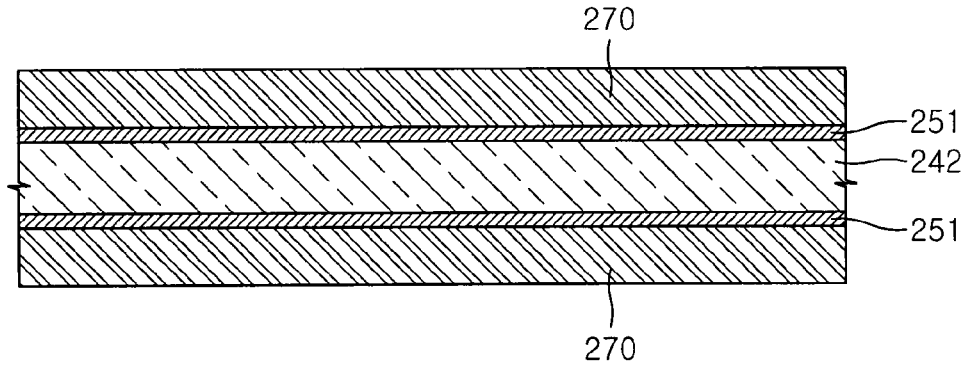
FIGS. 11A through 11C are cross-sectional views illustrating an operation of forming a resist layer in a position in which electrodes not formed.
Figure 11B:
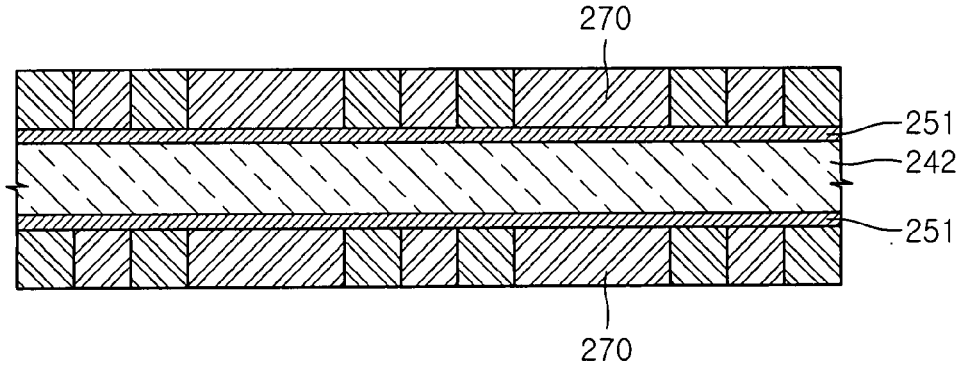
Figure 11C:
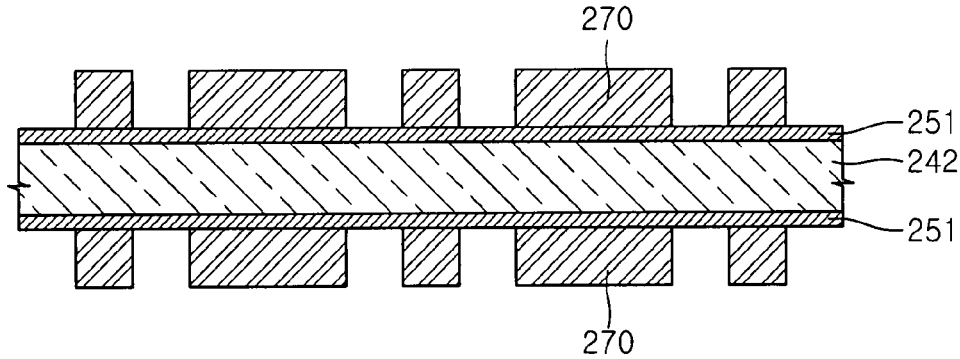

After that, as illustrated in FIGS. 11A through 11C, the resist layer 270 is formed in a position in which electrodes 252 and 253 (see FIG. 12) on the electrode seed layers 251 are not to be formed. In this case, the position in which the electrodes 252 and 253 are not to be formed means a position in which the front and rear discharge electrodes 252 and 253 are not formed in the discharge space and the dielectric barrier ribs of the PDP, for example.

The resist layer 270 is formed of a photosensitizer and is developed and exposed so that a predetermined pattern can be formed in the resist layer 270. That is, as illustrated in FIG. 11A, a surface of the base plate 242 on which the electrode seed layers 251 is applied using a photosensitizer (resist layer 270), as illustrated in FIG. 11B, one of a portion 270*a* in which electrodes are to be formed and a portion 270*b* in which the electrodes are not to be formed, of the photosensitizer 270 is selected and exposed to the outside, and as illustrated in FIG. 11C, a portion of the photosensitizer 270 in which the electrodes are to be formed is removed. In this case, the photosensitizer may be DFR (dry film photoresist). DFR is a photosensitive material that is used to manufacture high-density and high-integration circuit board such as a PCB or a lead frame. Alternatively, the photosensitizer may be formed of casein or other materials.

In this case, when the electrodes 250 (see FIG. 12) are disposed on both sides of the base plate 242, the top electrode seed layer 251 a disposed on the top surface of the base plate 242 and the bottom electrode seed layer 251*b* disposed on the bottom surface of the base plate 242 may extend in one direction. Alternatively, the top electrode seed layer 251*a* and the bottom electrode seed layer 251*b* may extend to cross each other.

Figure 12:
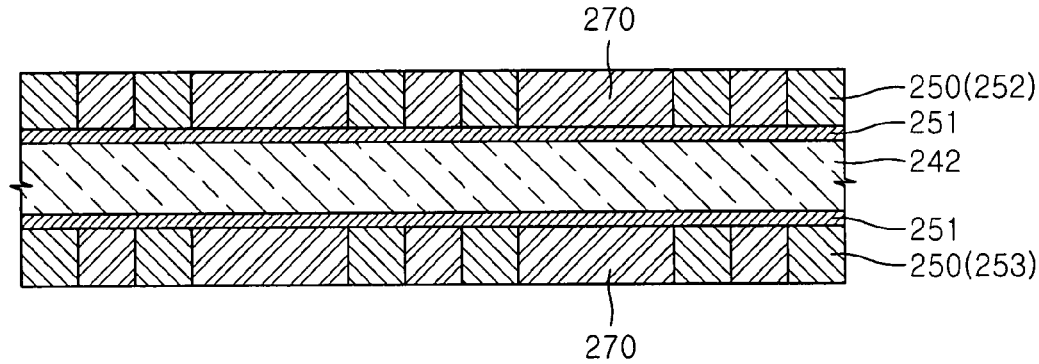

After that, as illustrated in FIG. 12, the electrode seed layers 251 are electroplated, and electrodes 250 are formed in a region in which the resist layer 270 is not formed.

The electrodes 250 are formed using the plating process so that a thickness of the electrodes 250 can be increased. In the PDP illustrated in FIGS. 3 through 8, a thickness of the front discharge electrode 152 or the rear discharge electrode 153 buried in the dielectric wall 140 is about 30 μm. However, when the electrodes are formed using a conventional printing process, the electrodes are not printed at a time by the thickness of 30 μm. Thus, the printing process is repeatedly performed by a thickness of 10 μm so that the electrodes are formed. As such, the process of manufacturing electrodes becomes complicated and as the size of the pixels is reduced, there is a limitation in reducing the electrode width. However, according to the present invention, the electrodes having a thickness of 30 μm can be formed at a time such that a manufacturing process is simple, manufacturing costs are reduced and electrodes having a high reliability can be formed.

Figure 13:
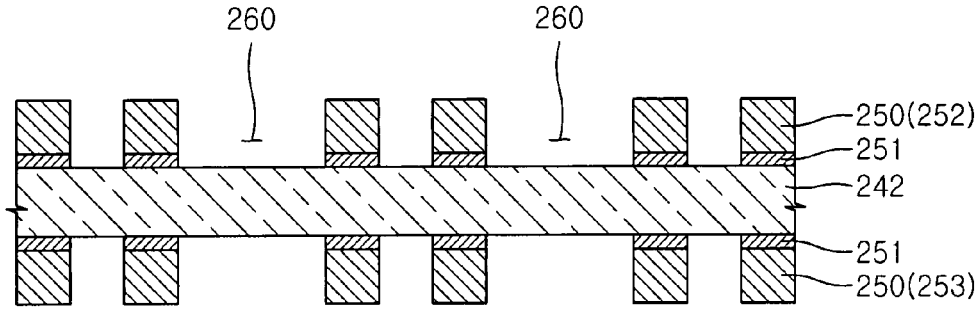

Next, as illustrated in FIG. 13, the resist layer 270 that exists on the base plate 242 and the electrode seed layers 251 disposed in the same position as that of the resist layer 270 are removed. In this case, the resist layer 270 is stripped and removed so that the electrode seed layers 251 exposed to the outside is removed using etching.

Figure 14:
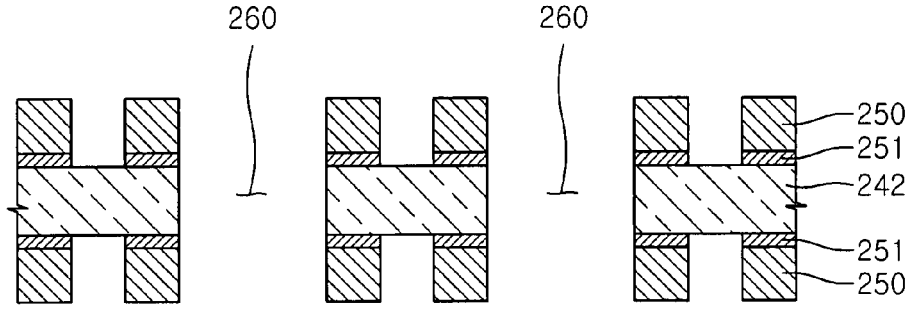

Next, as illustrated in FIG. 14, a portion of the base plate 242 corresponding to the discharge space is penetrated using a penetration means such as a drill etc. and is removed. Since the base plate 242 can be formed of a material for a PCB such as an organic material etc. such that a hole can be formed using a laser drill and productivity is improved compared to a case where a mechanical drill is used.

Figure 15:
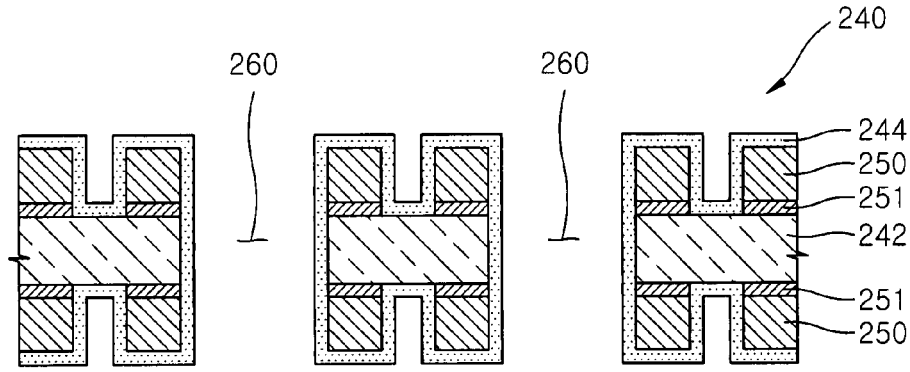
Figure 16:
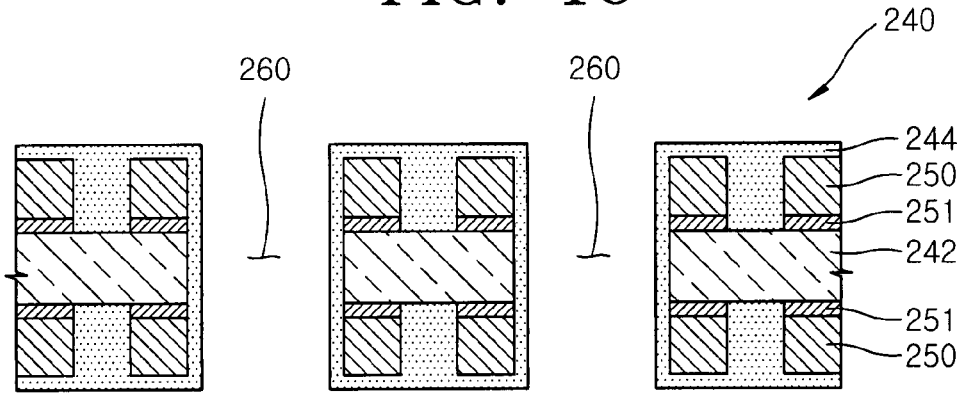

Next, as illustrated in FIGS. 15 and 16, the remaining base plate 242, the electrode seed layers 251, and the electrodes 250 are buried by the dielectric layer 244. The dielectric layer 244 prevents the electrodes from being damaged by positive ions or electrons and is formed of a dielectric that can induce charges. In the case of the PDP 100 illustrated in FIGS. 3 through 8, the dielectric layer is the high dielectric layer 144.

In this case, the dielectric layer 244 is formed of a material having a dielectric constant of 2-4 and an insulating withstanding voltage of 30-400 V/μm. The dielectric layer 244 can be formed to surround the base plate 242, the electrode seed layer 251, and the electrodes 250 to a thickness of 0.1-0.5 mm. As a result, the dielectric wall 240 manufactured according to the present invention need not to be baked as described above such that a variety of materials for the dielectric layer 244 can be selected. As such, the thickness of the dielectric wall can be reduced compared to the prior art such that a discharge space is relatively large, conductivity between electrodes is increased and a consumption voltage is reduced. As such, the effects are increased when the dielectric wall manufactured according to the present invention are used in a display panel having fine pixels.

In this case, as illustrated in FIG. 15, the electrodes 250 and the base plate 242 can be coated with the dielectric layer 244 having a uniform thickness. Unlike this, as illustrated in FIG. 16, a height of the dielectric layer 244 may be the same. In addition, the dielectric layer 244 can be formed to surround the base plate 242 corresponding to a discharge space and the electrodes 250.

Next, although not shown, a protective layer can be formed on at least a side of the dielectric 244 corresponding to the discharge space.

In the method according to the present invention, the dielectric wall 240 can be formed separately from a process of forming the front substrate 120 (see FIG. 3) and the rear substrate 130 (see FIG. 4). In this case, the electrodes 150 and the dielectric wall 140 for burying the electrodes 150 etc. are not formed on the front substrate 120 (see FIG. 3) on which an image is realized such that a time required for combining the front substrate 120 and the dielectric wall 140 is reduced.

Figure 17A:
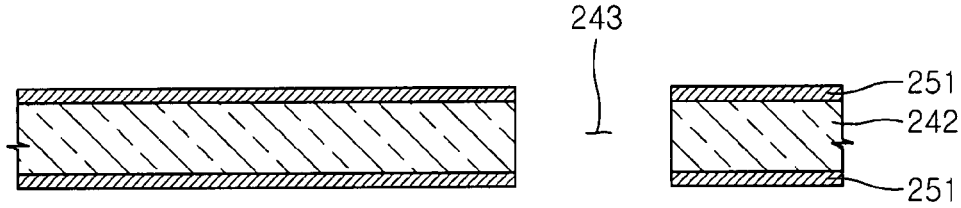
FIGS. 17A through 17C are cross-sectional views illustrating some operations of the method illustrated in FIG. 8 when a through hole is formed in the base plate.
Figure 17B:
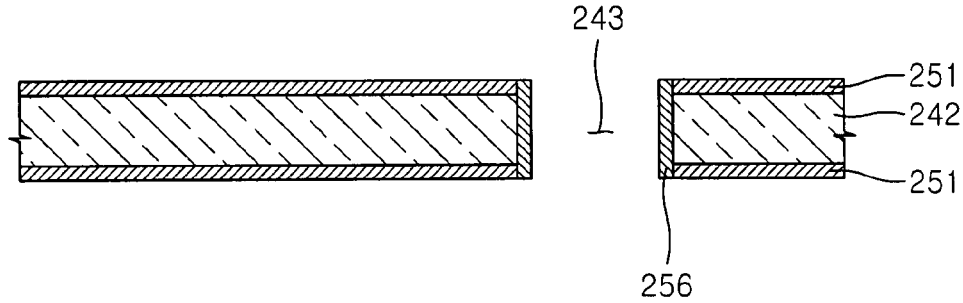

When the electrode seed layers 251 are formed on top and bottom surfaces of the base plate 242, the electrodes 252 and 253 to be respectively formed on the electrode seed layers 251 may be connected to external terminals at the same height. Thus, the method may further include an operation of forming a through hole 243 through which upper and lower portions of the base plate 242 are penetrated, as illustrated in FIG. 17A and an operation of forming a hole correspondence seed layer 256 connected to one of the electrode seed layers 251 disposed on top and bottom surfaces of the base plate 242 on an inner side surface of the through hole 243, as illustrated in FIG. 17B. In this case, the operation of forming the hole correspondence seed layer 256 on the inner side surface of the through hole 243 may be performed by electroless-plating the base plate 242.

Figure 17C:
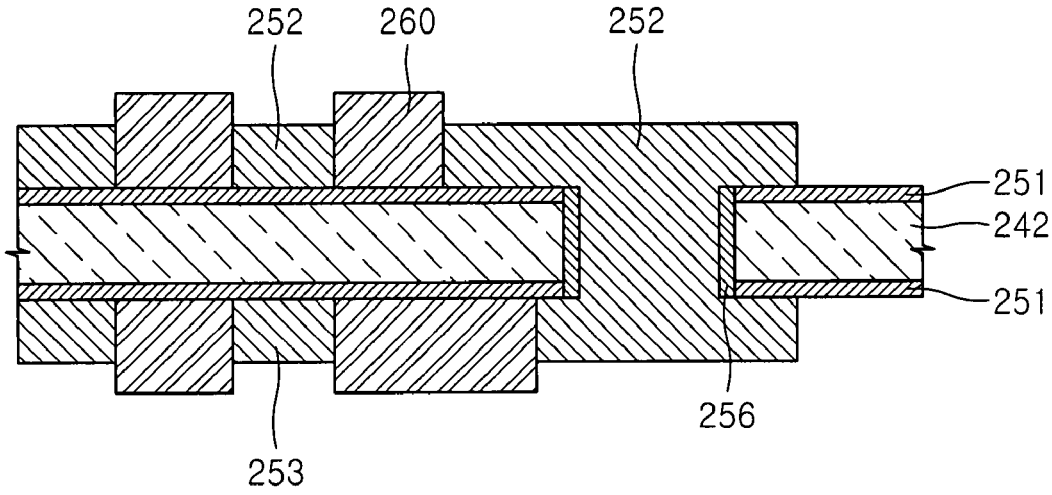

Next, as illustrated in FIG. 17C, the electrodes 250 can be formed inside the through hole 243 through electroless plating. For example, referring to FIG. 17C, the hole correspondence seed layer 256 can be formed to be adhered to the top electrode seed layer 251*a* so that the electrodes 252 and 253 placed on upper and lower sides of the base plate 242 can be connected to respective external terminals. Thus, after that, the upper electrodes can extend to the lower side of the base plate 242 along the through hole 243 and can be connected to the external terminals. In this case, a desmear process can be further performed so as to remove residuals or foreign substances in the through hole 243 before the hole correspondence seed layer 256 is formed after the through hole 243 is formed.

As described above, according to the present invention, electrodes and the dielectric wall for burying the electrodes are not disposed in a region in which visible rays generated in the PDP transmit such that a light-passing characteristic of the panel is excellent, power consumption is reduced and a discharge space is increased. Accordingly, the efficiency of the PDP is increased.

In addition, the dielectric wall for burying the electrodes are formed without going through a baking process and the electrodes buried in the dielectric wall are formed through a plating process such that a variety of materials for the dielectric wall can be selected, manufacturing costs are reduced and manufacturing process is simple.

In addition, the thickness of the dielectric wall is reduced such that the discharge space of the display panel is increased, power consumption is reduced and the efficiency of the PDP is increased.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A method of manufacturing an electrode burying dielectric wall for a display panel for realizing an image through a discharge in a discharge space between substrates separated from each other in a vertical direction and in which at least two electrodes disposed between the substrates in a vertical direction are buried in the vertical direction at regular intervals, the method comprising:

providing a base plate;

forming electrode seed layers made of a conductive material on at least one side of the base plate;

forming a resist layer for forming electrodes on the electrode seed layers;

forming the electrodes in a region in which the resist layer is not formed, by electro-plating the electrode seed layers;

removing the resist layer on the base plate and a portion of the electrode seed layers which are disposed at the same position as that of the resist layer;

subsequent to removing the resist layer, removing a portion of the base plate corresponding to the discharge space; and surrounding the electrodes and the base plate with dielectric having a larger dielectric constant than that of the base plate.

2. The method of claim 1, wherein the base plate comprises a material selected from the group consisting of polyimide, FR-6, and glass fiber reinforced epoxy.

3. The method of claim 1, wherein the resist layer is formed of a photosensitizer, and the removing of the resist layer corresponding to a position in which the electrodes of the electrode seed layers are formed is performed by exposing and developing the resist layer.

4. The method of claim 1, wherein the electrode seed layers are formed on both sides of the base plate, and between the steps of providing of the base plate and the forming of the resist layer, the method further comprises:

forming at least one through hole in the base plate; and forming a hole correspondence seed layer connected to one of the electrode seed layers formed on top and bottom surfaces of the base plate, on an inner side surface of the through hole.

5. The method of claim 1, wherein the electrode seed layers comprise a material selected from the group consisting of Ni, Cu, Cr, and Pd.

6. The method of claim 1, further comprising coupling a front substrate and a rear substrate, each of which are formed separately from the dielectric wall, with opposite sides of the dielectric wall.

7. A method of manufacturing a dielectric wall for a plasma display panel and in which front and rear discharge electrodes are buried, the method comprising:

providing an insulating layer;

forming electrode seed layers made of a conductive material on both sides of the insulating layer;

forming a resist layer in a portion of the electrode seed layers, the portion in which front and rear discharge electrodes are not formed;

forming front and rear discharge electrodes in a region in which the resist layer is not formed, by electro-plating the electrode seed layers;

removing the resist layer on both sides of the insulating layer and a portion of the electrode seed layers which are disposed at the same position as that of the resist layer;

subsequent to removing the resist layer, removing a portion of the insulating layer corresponding to a discharge space; and surrounding the insulating layer, the electrode seed layers, and the front and rear discharge electrodes by a high dielectric layer having a larger dielectric constant than that of the insulating layer.

8. The method of claim 7, wherein the insulating layer comprises a material selected from the group consisting of polyimide, FR-6, and glass fiber reinforced epoxy.

9. The method of claim 7, wherein the resist layer is formed of a photosensitizer, and the removing of the resist layer corresponding to a position in which the electrodes of the electrode seed layers are formed is performed by exposing and developing the resist layer.

10. The method of claim 7, wherein the electrode seed layers comprise a material selected from the group consisting of Ni, Cu, Cr, and Pd.

11. The method of claim 7, wherein the high dielectric layer is formed of a material having a dielectric constant of about between 2 and 4 and an insulating withstanding voltage of about 30 to 400 V/μm and the forming of the dielectric wall comprises surrounding the insulating layer, the electrode seed layers, and the front and rear discharge electrodes with the high dielectric layer to a thickness of about 0.1 to 0.5 mm of the high dielectric layer.

12. The method of claim 7, further comprising forming a protective layer covering at least a portion of sides of the high dielectric layer adjacent to the discharge space.

13. The method of claim 7, further comprising coupling a front substrate and a rear substrate, each of which are formed separately from the dielectric wall, with opposite sides of the dielectric wall.

* * * * *